United States Patent [19]

Sugasawa et al.

[11] 4,353,342

[45] Oct. 12, 1982

[54] FUEL INJECTION CONTROL SYSTEM

[75] Inventors: Fukashi Sugasawa, Yokohama; Haruhiko Iizuka, Yokosuka, both of Japan

[73] Assignee: Nissan Motor Company, Limited, Yokohama, Japan

[21] Appl. No.: 196,334

[22] Filed: Oct. 14, 1980

[30] Foreign Application Priority Data

Dec. 10, 1979 [JP] Japan ..... 54-131539

[51] Int. Cl.[3] ..... F02D 31/00

[52] U.S. Cl. ..... 123/493; 123/481

[58] Field of Search ..... 123/493, 198 F, 481

[56] References Cited

U.S. PATENT DOCUMENTS

| | | | |
|---|---|---|---|
| 4,204,483 | 5/1980 | Harada | 123/493 |
| 4,221,191 | 9/1980 | Asano | 123/493 |
| 4,274,382 | 6/1981 | Sugasawa | 123/481 |
| 4,276,863 | 7/1981 | Sugasawa et al. . | |

FOREIGN PATENT DOCUMENTS

| | | |
|---|---|---|
| 2101674 | 3/1972 | France . |
| 2155257 | 5/1973 | Japan . |
| 54-148929 | 11/1979 | Japan . |
| 2006336 | 5/1979 | United Kingdom . |

*Primary Examiner*—Ronald B. Cox

*Attorney, Agent, or Firm*—Schwartz, Jeffery, Schwaab, Mack, Blumenthal & Koch

[57] ABSTRACT

A fuel injection control system is disclosed for an internal combustion engine having fuel injectors. The system comprises fuel-cut means operable for rendering some of the fuel injectors inoperative only when the engine speed exceeds a first predetermined value during engine deceleration and for rendering the remaining fuel injectors inoperative when the engine speed exceeds a second predetermined value higher than the first predetermined value during engine deceleration. Control means is provided for rendering the fuel-cut means inoperative when rapid engine deceleration occurs, thereby permitting the operation of all of the fuel injectors regardless of the engine speed.

3 Claims, 1 Drawing Figure

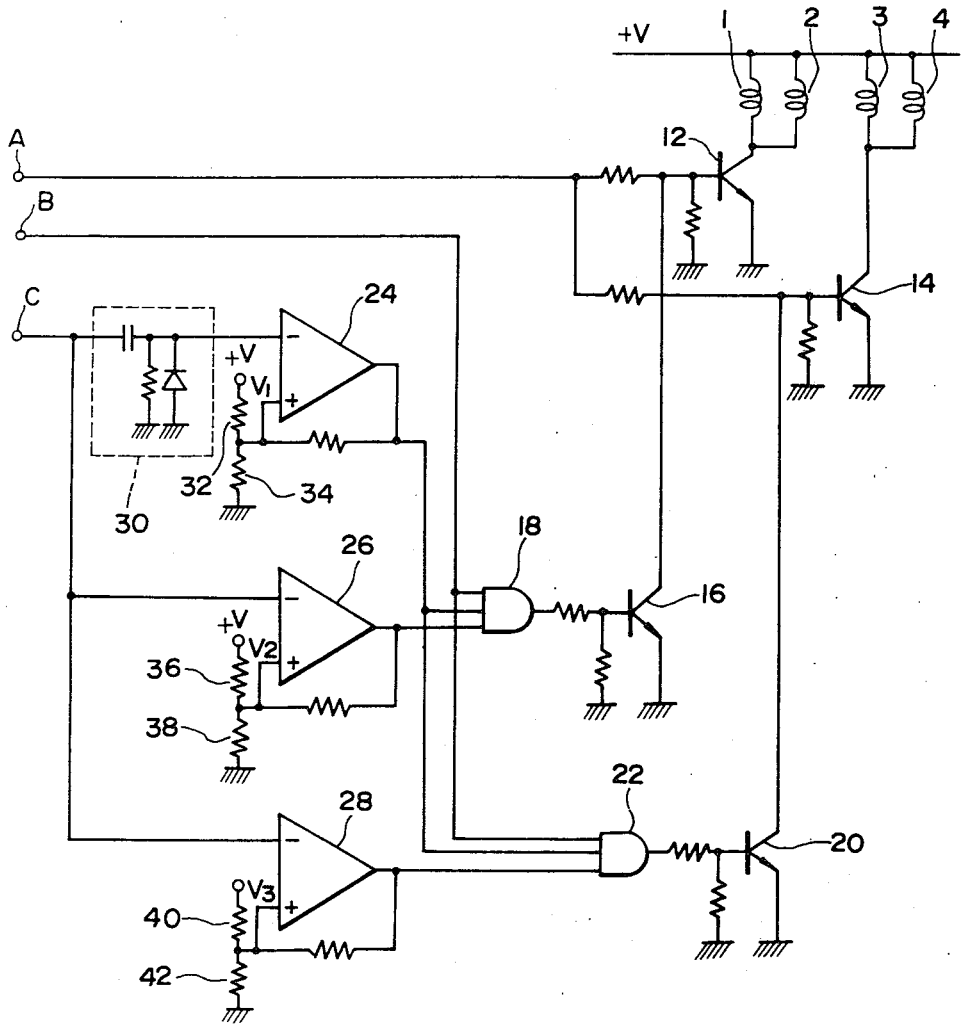
+V
1
2
3
4
A
B
C
12
14
24
+V
V1
32
34
30
26
18
16
+V
V2
36
38
22
28
20
V3
40
42

FUEL INJECTION CONTROL SYSTEM

BACKGROUND OF THE INVENTION

1. Field of the Invention

This invention relates to a fuel injection control system for use with an internal combustion engine and, more particularly, to such a system for cutting off the supply of fuel to the engine during engine deceleration.

2. Description of the Prior Art

Electronic controlled fuel injection systems have already been proposed which includes a fuel-cut device for cutting off the supply of fuel to an internal combustion engine when the throttle valve is fully closed and the engine speed is above a predetermined reference value for fuel economy during engine deceleration.

With such conventional system, however, any attempt to lower the reference engine speed value so as to provide a wider fuel-cut range for higher fuel economy, would lead to a sudden engine speed drop at the start of fuel-cut and a sudden output torque change resulting in a vehicle shock upon fuel supply resumption. This is due to a time lag between an engine speed detection and an actual engine output torque appearance.

In order to suppress the suden engine speed drop as well as achieve higher fuel economy, improved systems have also been proposed which is adapted to cut off the supply of fuel to some of the cylinders when the engine speed is above a first predetermined value during engine deceleration and cut off the supply of fuel to the remaining cylinders when the engine speed is above a second predetermined value higher than the first predetermined value during engine deceleration. However, such conventional systems have been found unsatisfactory in that when rapid engine deceleration occurs, for example, just after engine racing, a sudden large engine speed drop appears which would result in an engine stalling.

The present invention provides means responsive to a rapid engine deceleration for resuming the supply of fuel to all of the cylinders of an engine.

SUMMARY OF THE INVENTION

The present invention provides a fuel injection control system for use with an internal combustion engine having fuel injectors for permitting the operation of all of the cylinders regardless of the engine speed whenever rapid engine deceleration occurs. The system comprises means for providing, in synchronism with engine rotation, a fuel injection pulse signal corresponding to the amount of air flow to the engine, thereby operating the fuel injectors. The flow of the fuel injection pulse signal to some of the fuel injectors is shut off when the engine speed is above a first predetermined value during engine deceleration. In addition, the flow of the fuel injection pulse signal to the remaining fuel injectors is cut off when the engine speed is above a second predetermined value higher than the first predetermined value during engine deceleration. This achieves high fuel economy during engine deceleration.

Control means is provided for releasing the fuel-cut conditions when rapid engine deceleration occurs. That is, the fuel injection pulse signal is continuously applied to all of the fuel injectors during rapid engine deceleration regardless of the engine speed. Such rapid engine deceleration may be detected by using a throttle switch adapted to provide a signal when the throttle valve is fully closed. Preferably, the control means comprises means for providing a signal corresponding to the engine speed, a differentiating circuit for differentiating the engine speed indicative signal, and a comparator for comparing the differentiated signal with a reference value and releasing the fuel-cut conditions when the former is lower than the latter.

BRIEF DESCRIPTION OF THE DRAWING

The details as well as other features and advantages of this invention are set forth below and are shown in the accompanying drawing, in which:

The single FIGURE is a circuit diagram showing one embodiment of a fuel injection control system made in accordance with the present invention.

DESCRIPTION OF THE PREFERRED EMBODIMENT

Referring now to the single FIGURE, a fuel injection control system, embodying the present invention, is shown as incorporated in an internal combustion engine having individual fuel injectors 1 to 4 for each of the cylinders of the engine. The fuel injectors 1 to 4 are divided into two groups. The first group of fuel injectors 1 and 2 are commonly connected to ground through the collector-emitter circuit of a first switching transistor 12. The second group of fuel injectors 3 and 4 are grounded commonly through the collector-emitter circuit of a second switching transistor 14. The bases of the first and second transistors 12 and 14 are coupled to a fuel injection pulse signal A corresponding to the rate of air flow to the engine. The fuel injection pulse signal A is generated in synchronizm with engine crankshaft rotation from a conventional control unit (not shown). When the fuel injection pulse signal A goes high, the transistors 12 and 14 become conductive to open the first and second groups of fuel injectors, respectively, for a period of time corresponding to the rate of air flow to the engine.

The base of the first transistor 12 is grounded through the collector-emitter circuit of a third switching transistor 16, the base of which is connected to the output of a first AND circuit 18. The base of the second transistor 14 is connected to ground through the collector-emitter circuit of a fourth switching transistor 20 with its base connected to the output of second AND circuit 22. Each of the first and second AND circuits 18 and 22 has an input B from a throttle switch (not shown) which provides a high output when the throttle valve is in its fully closed position. In this embodiment, engine deceleration is inferred from the high output of the throttle switch. The first and second AND circuits 18 and 22 have a function to render the thrid and fourth transistors 16 and 20 conductive so as to cut off the fuel injection pulse signal A to the first and second transistors 12 and 14, respectively, when the throttle valve is fully closed; that is, during engine deceleration.

The first AND circuit 18 has additional two inputs, one connected to the output of a first comparator 24 and the other connected to the output of a second comparator 26. Also, the second AND circuit 22 has additional two inputs, one of which is connected to the output of the first comparator 24, the other input thereof being connected to the output of a third comparator 28.

The first comparator 24 has an inverting input connected through a differentiating circuit 30 to a signal C inversely proportional to the engine speed. The non-inverting input of the first comparator 24 is coupled to a reference voltage $V_1$ determined by the ratio of the values of resistors 32 and 34. The differentiating circuit 30 differentiates the engine speed indicative signal C and provides an output representing the rate of decrease of the engine speed. The first comparator 24 compares the differentiated signal with the reference voltage $V_1$ and provides a low output when rapid engine deceleration occurs.

The second comparator 26 has an inverting input connected to the engine speed indicative signal C and a non-inverting input connected to a reference voltage $V_2$ determined by the ratio of the values of resistors 36 and 38. The second comparator 26 compares the engine speed indicative signal C with the reference voltage $V_2$ and produces a low output when the former is higher than the latter. That is, the output of the second comparator 26 is at its low level when the engine speed is lower than a first predetermined vlaue represented by the reference voltage $V_2$.

The third comparator 28 has an inverting input coupled to the engine speed indicative signal C and a non-inverting input coupled to a reference voltage $V_3$ determined by the ratio of the values of resistors 40 and 42. The third comparator 28 compares the engine speed indicative signal C with reference voltage $V_3$ and produces a low output when the former is higher than the latter. That is, the output of the third comparator 28 is at its low level when the engine speed is lower than a second predetermined value represented by the reference voltage $V_3$. The resistors 36 to 42 are suitably selected such that the reference voltage $V_2$ is higher than the reference voltage $V_3$.

The operation of the fuel injection control system of the present invention will now be described. Assuming first that the engine is gently decelerated but the engine speed is above the second predetermined value determined by the resistors 40 and 42, all of the outputs of the throttle switch, and that first, second and third comparators 24, 26 and 28 are high. Consequently, the first and second AND circuits 18 and 22 provide high outputs to the third and fourth transistors 16 and 20 which thereby become conductive to cut off the flow of the fuel injection pulse signal A to the first and second transistors 12 and 14, respectively. This renders the first and second groups of fuel injectors 1 to 4 inoperative to shut off the supply of fuel to the respective cylinders.

When the engine speed falls below the second predetermined value but above the first predetermined value, the output of the third comparator 28 goes low to change the output of the second AND circuit, 22 to its low level. This renders the fourth transistor 20 non-conductive to permit application of the fuel injection pulse signal A to the second transistor 14. As a result, the second group of fuel injectors 3 and 4 become operative to resume the supply of fuel to the associated cylinders.

When the engine speed further falls below the first predetermined value, the output of the second comparator 26 goes low to change the output of the first AND circuit 18 to its low level. This renders the third transistor 16 non-conductive to permit application of the fuel injection pulse signal A to the first transistor 12. As a result, the first group of fuel injectors 1 and 2 become operative to reusme the supply of fuel to the associated cylinders. In this state of the circuit, fuel is supplied through all of the fuel injectors 1 to 4 to the respective cylinders.

If rapid engine deceleration occurs, the output of the differentiating circuit 30 becomes higher than the reference voltage $V_1$ determined by the resistors 32 and 34 to change the output of the first comparator 24 to its low level, which in turn changes the outputs of the first and second AND circuits 18 and 22 to the low level no matter what the engine speed is. That is, the fuel injection control system of the present invention is responsive to rapid engine deceleration to resume the supply of fuel to all of the cylinders regardless of the engine speed. This is effective to prevent any engine speed drop found when rapid engine deceleration occurs in conventional fuel injection control systems.

While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A fuel injection control system for use with an internal combustion engine having fuel injectors, comprising:

(a) means for providing a fuel injection pulse signal (A) corresponding to the rate of air flow to said engine, thereby operating said fuel injectors;

(b) a signal generator for providing a first signal when the engine speed is above a first predetermined value and for providing a second signal when the engine speed is above a second predetermined value higher than said first predertermined value;

(c) fuel-cut means operable for cutting off the flow of the fuel injection pulse signal to some of said fuel injectors in response to said first signal during engine deceleration and for cutting off the flow of the fuel injection pulse signal to the remaining fuel injectors in response to said second signal during engine deceleration.

(d) control means for rendering said fuel-cut means inoperative when rapid engine deceleration occurs, thereby permitting application of the fuel injection pulse signal to all of said fuel injectors regardless of the engine speed.

2. A fuel injection control system according to claim 1, wherein said control means comprises means for providing a signal corresponding to engine speed, a differentiating circuit for differentiating the engine speed indicative signal, and a comparator for comparing the differentiated signal with a reference value and rendering said fuel-cut means inoperative when the former is higher than the latter.

3. A fuel injection control system according to claim 1, wherein said signal generator comprises a first comparator for comparing a signal corresponding to engine speed with a first reference value to provide said first signal when the former is higher than the latter, and a second comparator for comparing the engine speed indicative signal with a second reference value larger than said first reference value to proide said second signal when the former is higher than the latter.

* * * * *